US010513374B2

(12) United States Patent
Stodd et al.

(10) Patent No.: US 10,513,374 B2
(45) Date of Patent: Dec. 24, 2019

(54) RECLOSABLE LID FOR A FOOD OR BEVERAGE CONTAINER AND HAVING A VACUUM OR PRESSURE RELEASE BUTTON

(71) Applicant: Container Closure Technologies LLC, Dayton, OH (US)

(72) Inventors: R. Peter Stodd, Bellbrook, OH (US); James Bach, Greenfield, OH (US)

(73) Assignee: Consumer Convenience Technologies LLC, Dayton, OH (US)

( * ) Notice: Subject to any disclaimer, the term of this patent is extended or adjusted under 35 U.S.C. 154(b) by 0 days.

(21) Appl. No.: 15/996,888

(22) Filed: Jun. 4, 2018

(65) Prior Publication Data

US 2018/0339814 A1 Nov. 29, 2018

Related U.S. Application Data

(63) Continuation-in-part of application No. 15/605,050, filed on May 25, 2017.

(51) Int. Cl.
*B65D 43/02* (2006.01)
*B65D 51/16* (2006.01)
(Continued)

(52) U.S. Cl.
CPC ..... *B65D 43/0202* (2013.01); *B21D 51/443* (2013.01); *B65D 17/404* (2018.01); *B65D 43/0231* (2013.01); *B65D 51/1677* (2013.01); *B65D 81/2015* (2013.01); *B65D 2205/00* (2013.01); *B65D 2251/01* (2013.01); *B65D 2517/0011* (2013.01); *B65D 2517/5056* (2013.01); *B65D 2543/0037* (2013.01); *B65D 2543/00092* (2013.01);
(Continued)

(58) Field of Classification Search
CPC ..... B65D 17/28; B65D 17/40; B65D 17/404; B65D 2205/025; B65D 2517/0011; B65D 2517/0089; B65D 2517/0092; B65D 2517/0094; B65D 2517/5056; B65D 2543/0037; B65D 2543/00935; B65D 51/1672; B65D 51/1677
See application file for complete search history.

(56) References Cited

U.S. PATENT DOCUMENTS 2,761,594 A * 9/1956 Stroh ..... B65D 83/206 137/382
3,152,711 A 10/1964 Mumford et al.
(Continued)

*Primary Examiner* — Mollie Impink
(74) *Attorney, Agent, or Firm* — Jacox, Meckstroth & Jenkins

(57) ABSTRACT

A sheet metal lid has a rim portion removably secured and sealed to a container and the lid includes a vent button having a top wall portion surrounded by a side wall portion and an outwardly projecting flange portion. The flange portion of the button has a short arcuate score or shear line extending substantially into the sheet metal, and additional score lines extend into the flange portion at lesser depths to protect a coating on the inner surface of the lid. A resilient sealant material may be bonded to the inner surface of the vent button, and the opposing sheet metal portions of the score line form a small gap for releasing a vacuum or pressure from the container in response to a controlled downward pressure on the top wall portion of the vent button.

7 Claims, 11 Drawing Sheets

(51) Int. Cl.
*B65D 17/28* (2006.01)
*B65D 81/20* (2006.01)
*B21D 51/44* (2006.01)

(52) U.S. Cl.
CPC ..... *B65D 2543/00277* (2013.01); *B65D 2543/00416* (2013.01); *B65D 2543/00537* (2013.01); *B65D 2543/00972* (2013.01)

(56) References Cited

U.S. PATENT DOCUMENTS 3,355,058 A 11/1967 Asbury
3,410,436 A 11/1968 Foss et al.
3,606,106 A * 9/1971 Yuhas ..... B65D 83/20 222/153.07
4,054,228 A * 10/1977 Balocca ..... B65D 17/401 220/268
4,128,186 A * 12/1978 Gane ..... B65D 17/401 220/268
5,680,952 A 10/1997 Chasteen
5,738,237 A * 4/1998 McEldowney .... B65D 17/4012 220/269
5,979,688 A 11/1999 Stodd
6,206,220 B1 3/2001 Stodd
6,343,725 B1 * 2/2002 Lohrman ..... B65D 47/2006 222/153.14
8,893,906 B2 11/2014 Szczesniak et al.
9,033,175 B2 * 5/2015 Frank ..... B21D 19/12 220/270
9,701,447 B2 7/2017 Stodd
2010/0227191 A1 * 9/2010 Brown ..... B32B 15/016 428/586
2014/0103044 A1 4/2014 Ramsey et al.
2017/0333285 A1 * 11/2017 Lecuyer ..... A61J 1/18

* cited by examiner

RECLOSABLE LID FOR A FOOD OR BEVERAGE CONTAINER AND HAVING A VACUUM OR PRESSURE RELEASE BUTTON

RELATED APPLICATION

This application is a continuation-in-part of application Ser. No. 15/605,050, filed May 25, 2017.

BACKGROUND OF THE INVENTION

This invention relates to a closure or lid for a food or beverage container as disclosed, for example, in applicant's U.S. Pat. Nos. 5,979,688, 6,206,220, and 9,701,447 the disclosures of which are herein incorporated by reference. These patents are directed to a thin sheet metal closure or cap or lid for a sealed food or beverage container wherein the closure is removably sealed to the container and reclosable on the container. Commonly, the container is formed of glass but may also be formed plastic or thin sheet metal, and the vacuum or pressure within the sealed container is released to facilitate or simplify the removal of the closure or lid from the container with reduced torque. Other forms of containers with reusable closures for containers and having a vacuum or pressure release structure before the closure is removed from the container are disclosed in U.S. Pat. No. 3,410,436 and U.S. Patent Publication No. US 2014/0103044, As used herein, the term container includes a glass or sheet metal or plastic container, and the term lid includes any form of removable closure such as a twist-on, twist-off sheet metal cap or a press-on, press-off sheet metal cap or lid for a container. The lid has a peripheral chime or rim portion with a bonded sealant material to form a releasable sealed coupling between the lid and the container.

The lid inner surface may also have a thin plastic coating which protects the contents of the container from exposure to the sheet metal forming the lid. In such an enclosed container and lid assembly, it has been found desirable to add an easily activated and dependable vacuum or pressure release button to the lid, including after the lid has been formed on tooling which shapes the lid and which may have bonded sealant material on the inner surface of the rim portion of the lid. It is also sometimes desirable to minimize the thickness of the sheet metal which forms the lid and to provide some form of visible tamper-proof indication when vacuum or pressure has been released from the container, for example, as disclosed in U.S. Pat. No. 3,152,911.

SUMMARY OF THE INVENTION

The present invention is directed to an improved sheet metal removable lid for a container having a vacuum or pressure enclosed food or beverage product and which includes a vacuum or pressure release button operable with a controlled and dependable pressure to facilitate easy removal of the lid, and to the tooling and method for producing the lid. The method steps of forming the lid are especially adapted for adding the vacuum or pressure release button to a lid which has been pre-formed for removably attaching to a glass jar or sheet metal container. In accordance with one embodiment of the invention, a sheet metal lid having a peripheral rim portion with a bonded sealant material has a center portion formed with tooling in successive stages of a progressive die to form an upwardly projecting vent button within an annular cavity. The button has a top wall portion surrounded by a side wall portion which is surrounded by a flange portion. A main or first score or shear line is formed within the flange portion adjacent the bottom of the side wall portion, and a small portion of the score line is formed to produce a small vent gap in response to a limited pressure on the top wall of the button. The score line extends through at least eighty percent of the thickness of the sheet metal forming the flange portion and may extend completely through the sheet metal. Additional score lines at lesser depths than the main score line may be formed in the flange portion of the button to prevent distortion of the flange portion and the inner plastic coating when forming the button.

An arcuate or annular rib or bead may project downwardly within the flange portion of the vent button and extends adjacent the main score line. The opposing flange portions that define the score or shear line may be pressed axially together or flattened for closing the shear line and controlling the pressure required on the top wall to separate the flange portions and define the small vent gap. A sealant material may be bonded to the inner surface of the vent button below the score line and may have a lip portion which extends to a retention bead. When the top wall of the vacuum release button is pressed downwardly, the opposing flange portions of the button separate and the lip portion of the sealant material extending to the bead peels away from the inner surface of the flange portion of the button and air or gas flows through the gap to release the vacuum or pressure within the container. When the button is released, the sealant recontacts the inner surface of the flange portion of the button due to spring hinge action produced by the sheet metal portions at the opposite ends of the main score line and by the reinforcement provided by the retention rib or bead. These sheet metal portions also limit the small vent gap.

Other features and advantages of the invention will be apparent from the following description, the accompanying drawings and the appended claims.

DESCRIPTION OF THE PREFERRED EMBODIMENTS

Figure 1:
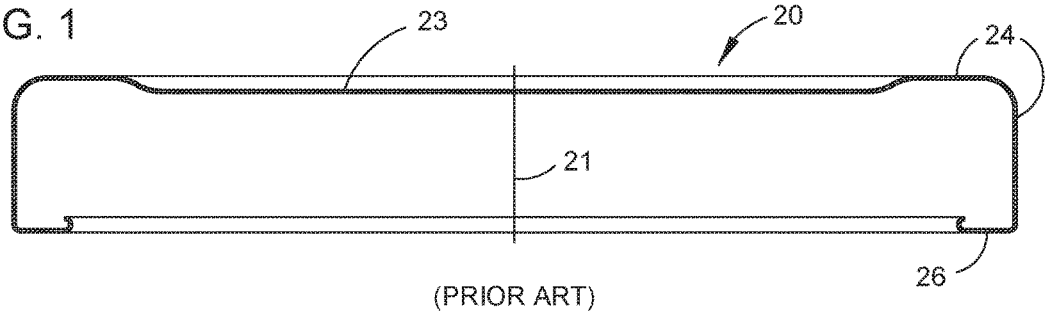
FIG. 1 is a vertical section of a conventional sheet metal lid before sealant material is bonded to the rim portion of the lid.
Figure 2:
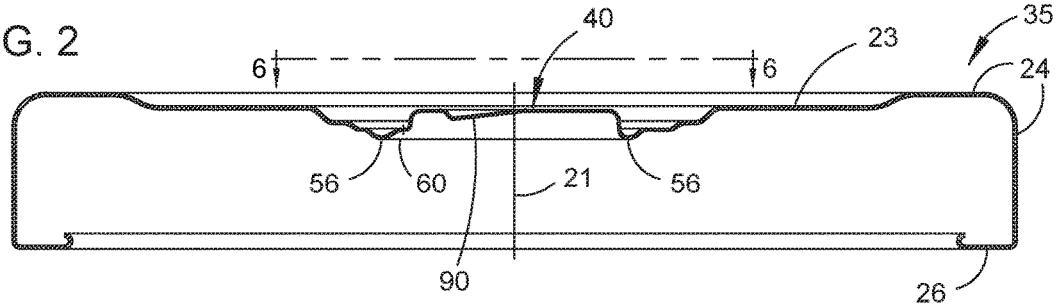
(PRIOR ART) FIG. 2
FIG. 2 is a vertical section of the lid shown in FIG. 1 and with a center portion of the lid formed with a vacuum or pressure release button in accordance with the invention.

FIG. 1 illustrates a conventional sheet metal removable lid 20 having a vertical center line 21 and commonly formed from thin sheet steel having a thickness of about 0.007 or 0.008 inch. The lid 20 includes a flat circular top wall 23 surrounded by peripheral horizontal rim portion 24 with inwardly projecting portions 26 for releasably engaging or coupling the lid 20 to an upper portion 28 of a container 30 (FIG. 4) in a conventional manner with a twist on, twist off coupling or a press-on and press-off coupling to the container. The inner surface of the rim portion 24 includes an annular bonded resilient sealant material 34 (FIG. 3) such as a food grade PVC or plastisol, which forms a tight seal with the container 30, in a conventional manner. Either before or after the annular layer of sealant material 34 is added to the lid 20, the lid is formed by progressive die stages to produce a removable lid 35 (FIG. 2) having a push button vacuum or pressure release vent button 40 constructed in accordance with the invention.

Figure 4:
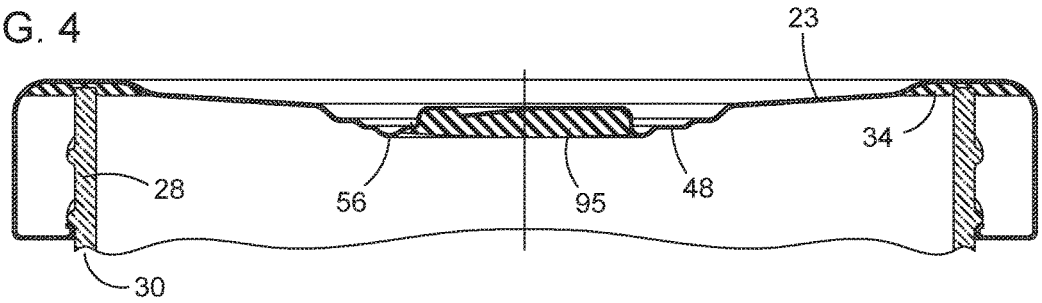
FIG. 4 illustrates the lid of FIG. 3 secured to the top portion of a glass container having a food or beverage product.
Figure 5:
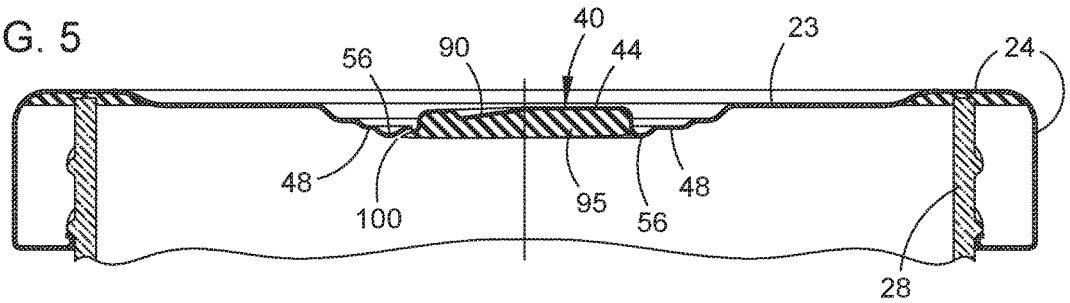
FIG. 5 shows the lid of FIG. 4 after the vacuum or pressure release button has been depressed.
Figure 6:
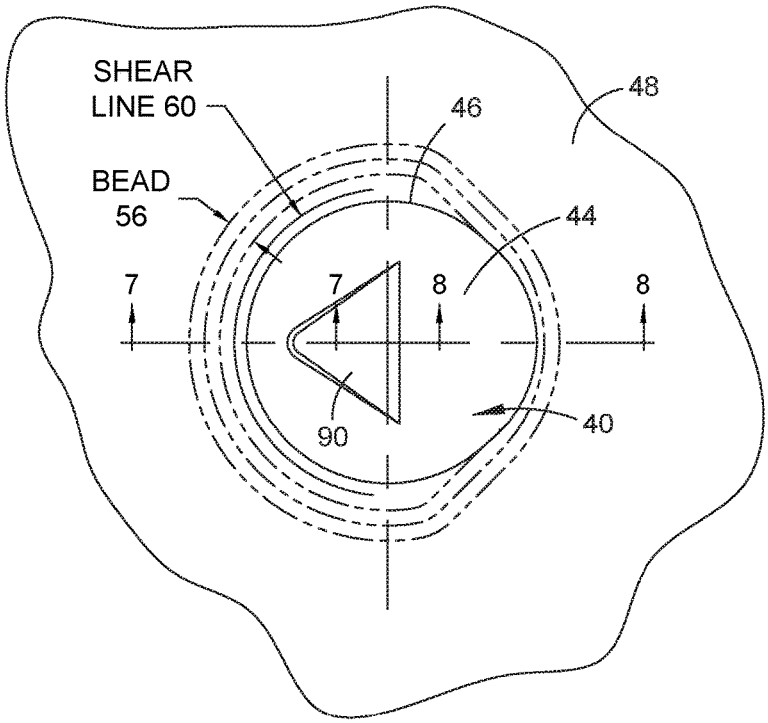
FIG. 6 is a fragmentary plan view of a vacuum or pressure release button constructed in accordance with the invention.
Figure 7:
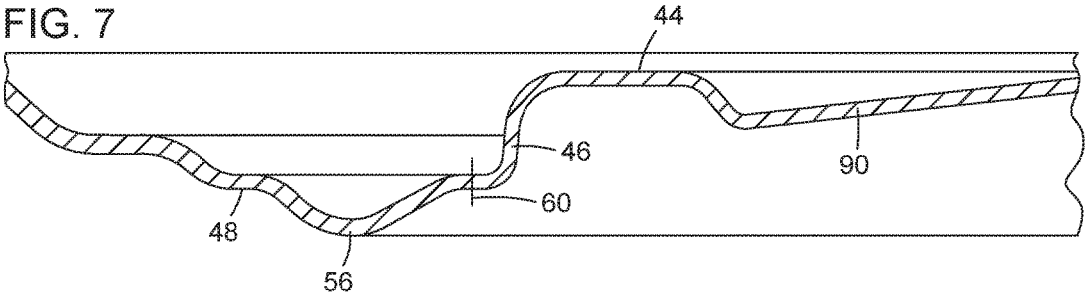
FIG. 7 is an enlarged fragmentary section of the button, taken generally on the line 7-7 of FIG. 6.
Figure 8:
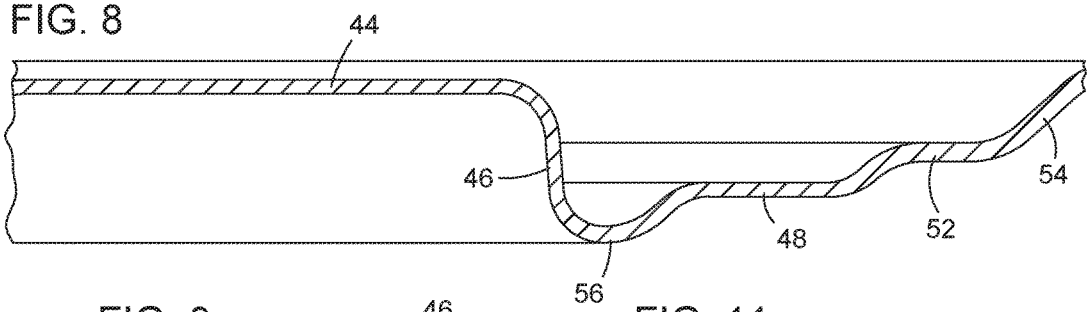
FIG. 8 is a larger fragmentary section of the lid, taken generally on the line 8-8 of FIG. 6.

Referring to FIGS. 3-8, the vent button 40 is preferably circular and may be located in the center portion of the lid 35. The vent button 40 includes a substantially flat top wall portion 44 surrounded by a side wall portion 46 which extends to a surrounding flange wall portion 48. The flange wall portion 48 extends to an outer flange portion 52 (FIG. 8) connected by an inclined annular wall portion 54 (FIGS. 7 & 8) to the top wall 23 of the lid. A downwardly projecting annular rib or bead 56 projects below the flange wall portion 48. As shown in FIG. 7, a semi-circular or arcuate portion of the bead 56 is spaced outwardly from the side wall portion 46 of the button 40, and as shown in FIGS. 6 and 8, the bead 56 extends at the bottom of the side wall portion 46 of the vent button 40.

Figure 9:
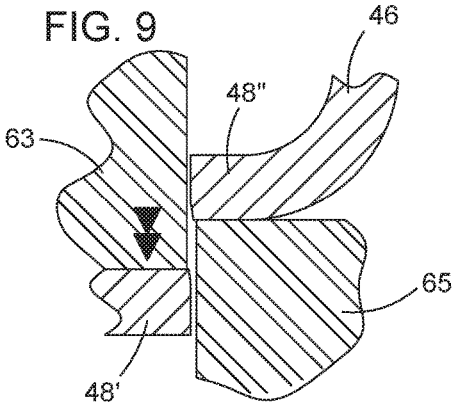
FIG. 9 is an enlarged fragmentary section of the lid and tooling for lancing or completely shearing the button on the shear line shown in FIG. 7.
Figure 11:
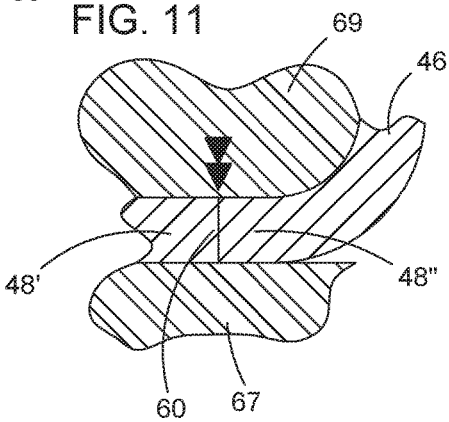
FIG. 11 is an enlarged fragmentary section of the button after being sheared or lanced as shown in FIG. 9 and compressed back together.

Referring to FIGS. 6 & 7, an arcuate shear line 60 extends into the flange portion 48 and is located radially inwardly from the downwardly projecting bead 56 and adjacent the side wall portion 46 of the vent button. As shown in FIG. 9, the shear line 60 may extend completely through the flange portion 48 of the button 40 and this is performed by lancing the flange portion between shear die tooling components 63 and 65 to separate opposing flange portions 48' and 48". After the shearing or lancing operation of FIG. 9, the opposing flange portions 48' and 48" are pressed or compressed back together as shown in FIG. 11 and into alignment by tooling components 67 and 69 to form a tight friction fit between the opposing flange portions 48' and 48".

Figure 12:
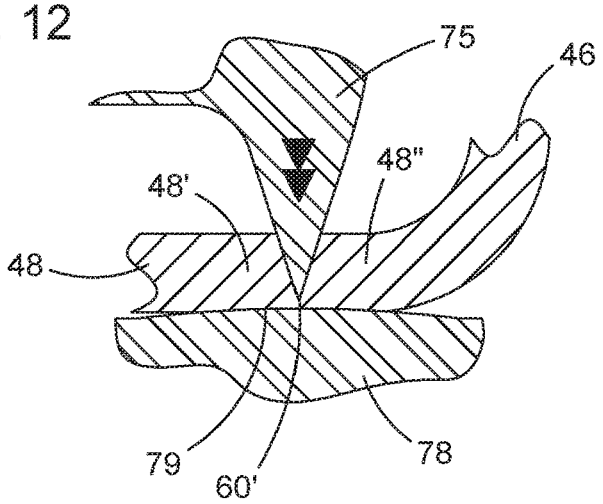
FIG. 12 is an enlarged fragmentary section of the button being lanced or scored by opposing tooling components.
Figure 13:
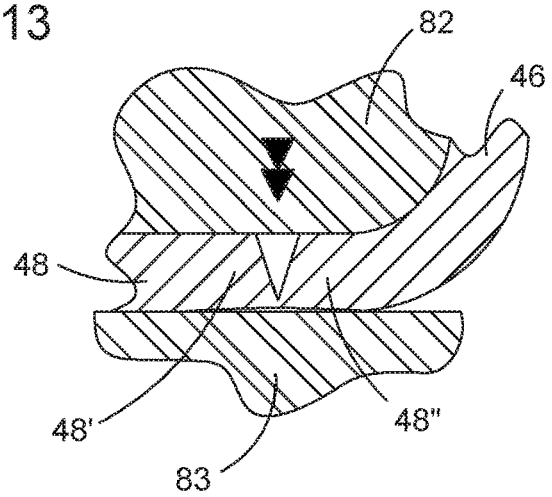
FIG. 13 is a fragmentary section similar to FIG. 12 and showing the scored lid being flattened or compressed between tooling components.

The optimum desired downward pressure on the vent button 40 to separate the flange portions 48' and 48" at the shear line 60, may also be obtained by pressing a shearing or scoring tool 75 (FIG. 12) into the flange portion 48 of the vent button 40 and against a tooling component or anvil 78 having a slightly crowned top surface 79. The shearing or scoring tool 75 is pressed into the flange portion 48 by at least 80% of the sheet metal thickness of flange portion 48 so that the remaining or residual 60' at the shear line 60 is approximately 0.0008 inch or less and forms the opposing flange portions 48' and 48". As shown in FIG. 13, the opposing flange portions 48' and 48" are then flattened or pressed back together between opposing flat surfaces of tooling components or members 82 and 83.

Figure 14:
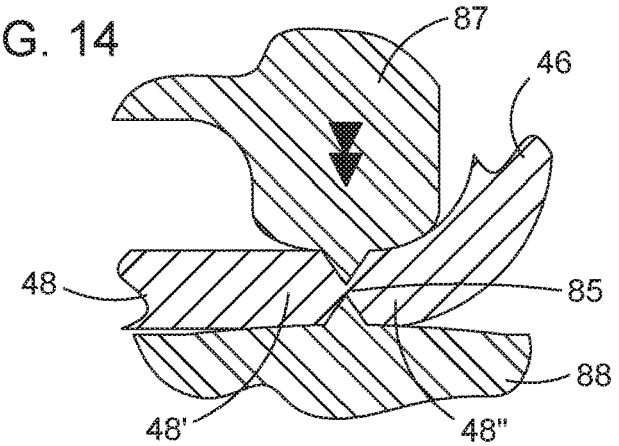
FIG. 14 is an enlarged fragmentary section showing a lid being double sheared or scored by opposing tooling components.

Referring to FIG. 14, the residual 85 at the shear line 60 of about 0.0008 inch may also be obtained by opposing shearing or scoring members or tools 87 and 88 which simultaneously shear or score from both the top surface and the bottom surface of the flange wall 48 to form the opposing flange portions 48' and 48" and produce the residual 85 at the shear line 60.

Figure 10:
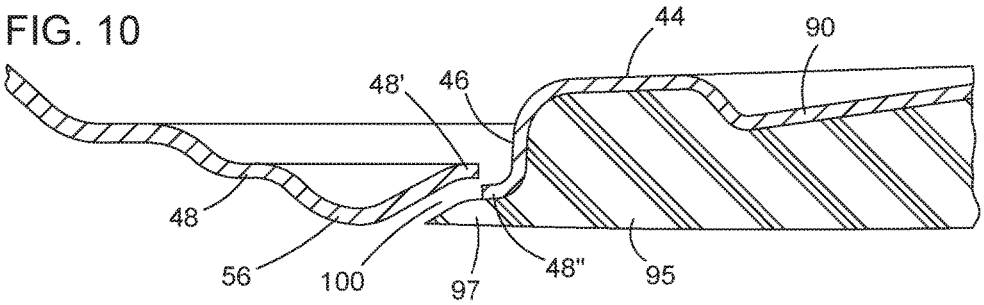
FIG. 10 is an enlarged fragmentary section of the lid shown in FIG. 5 after the button has been depressed.
Figure 15:
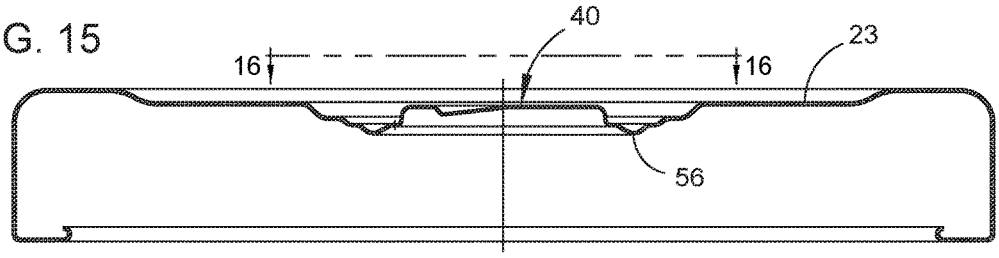
FIG. 15 is an axial section of a lid similar to FIG. 2 and having a modified vacuum release button formed in accordance with the invention.
Figure 16:
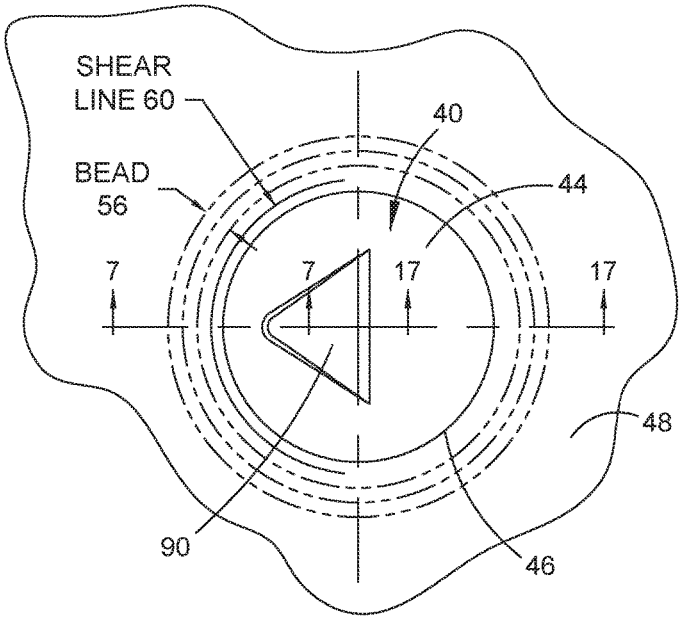
FIG. 16 is a fragmentary plan view similar to FIG. 6 and taken on the line 16-16 of FIG. 15.
Figure 17:
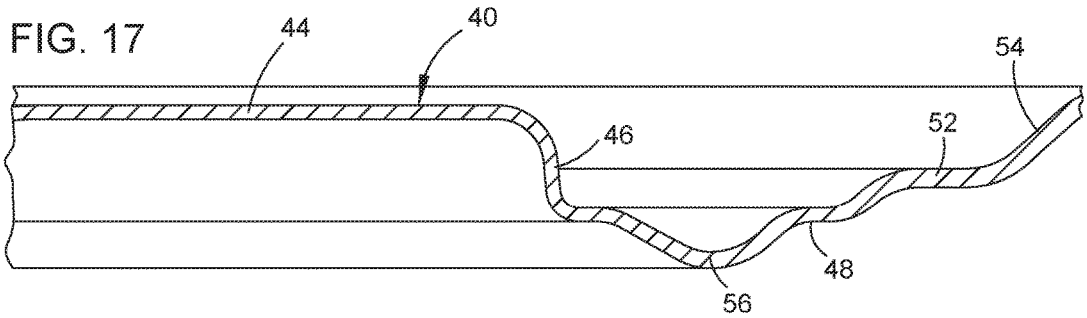
FIG. 17 is an enlarged fragmentary section of the lid shown in FIG. 15 and taken generally on the line 17-17 of FIG. 16.

Referring to FIGS. 15-17, the downwardly projecting rib or bead 56 is circular within the flange wall portion 48 of the vent button 40 and is concentric with the arcuate shear line 60 (FIG. 16). As also shown in FIG. 6 and FIG. 16, a generally triangular and tapered depression 90 is formed within the top wall portion 44 and provides an indication of where the top wall should be pressed above the shear line 60 to separate the opposing flange portions 48' and 48" as shown in FIGS. 5 and 10. As also shown in FIGS. 5 and 10, a sealant material 95 such as PVC or plastisol, which may be the same as the resilient sealant material 34, is added to the inner surface of the vent button 40 when the lid is inverted, and the sealant material includes a flange or lip portion 97 (FIG. 10) which projects radially past the arcuate shear line 60 and releasably attaches to the retention bead 56 formed in the flange wall portion 48 of the vent button 40.

Thus, when the top wall portion 44 of the vent button 40 is pressed downwardly with a predetermined pressure, the flange portions 48' and 48" separate (FIG. 10) and the flange or lip portion 97 of the sealant material 95 peels away from the retention bead 56 to form a very narrow space or gap 100 (FIG. 10). The gap permits air above the vent button 40 to flow into the container 28 or pressurized gas within the container to flow out of the container and eliminate any vacuum or pressure within the container. Since the sealant material 95 is in a fluid condition when it is added to the vent button 40, and is heated, the sealant material flows under the shear line 60 and is retained by the bead 56 under the flange wall portion 48 of the vent button.

Figure 3:
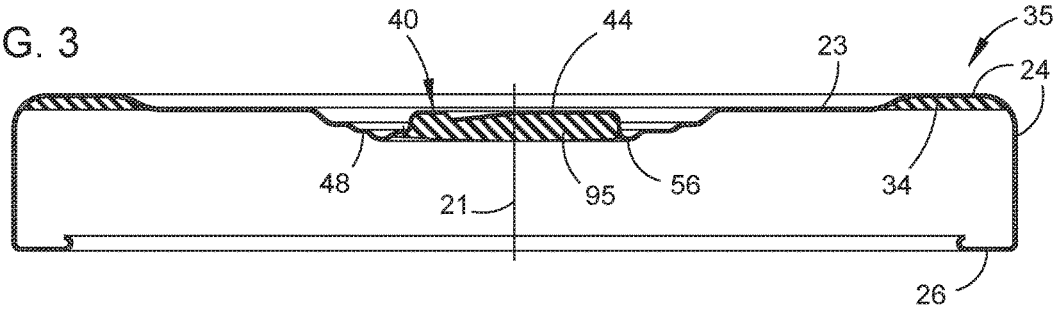
FIG. 3 is a vertical section similar to FIG. 2 and with a sealant material added to the outer rim portion of the lid and also added to the release button in accordance with the invention.
Figure 18:
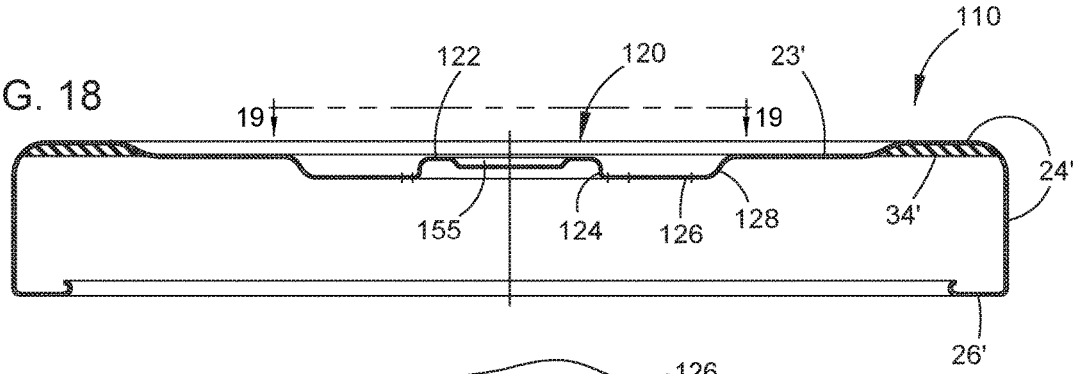
FIG. 18 is a vertical section of a lid formed in accordance with another embodiment of the invention and with a center portion formed with a vacuum or pressure release button in accordance with the invention.
Figure 19:
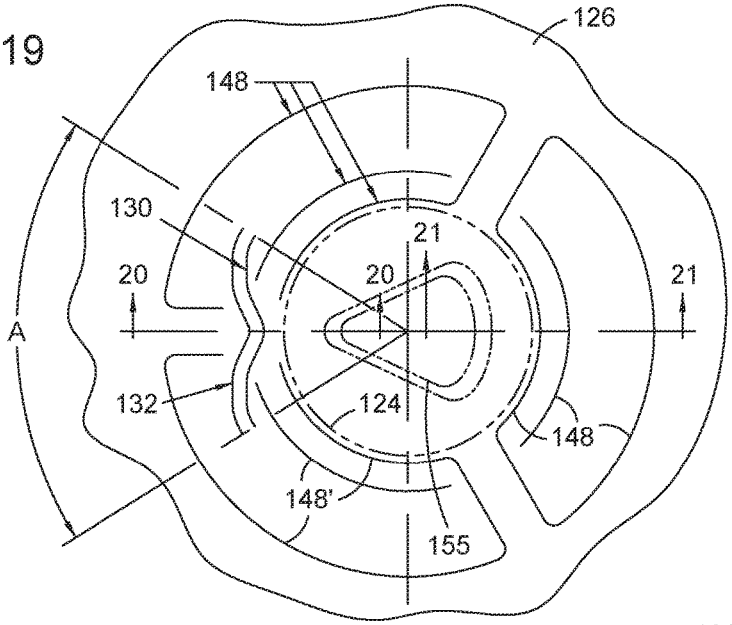
FIG. 19 is a plan or top view of the center portion shown in FIG. 18.
Figure 20:
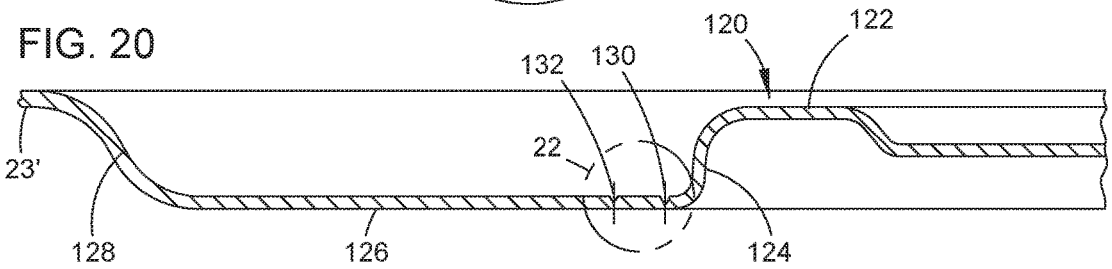
FIG. 20 is an enlarged fragmentary section of the button taken on the line 20-20 of FIG. 19.
Figure 21:
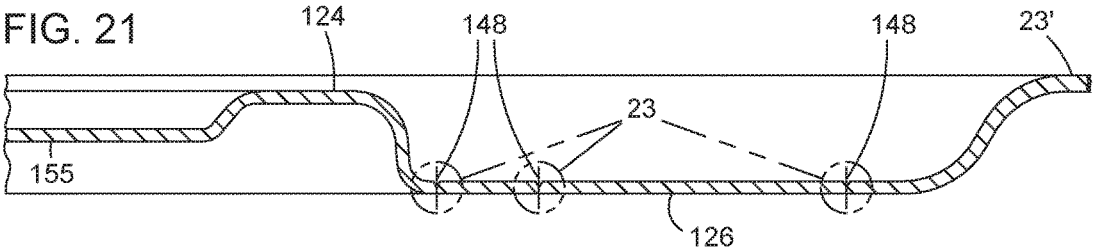
FIG. 21 is an enlarged fragmentary section of the button taken on the line 21-21 of FIG. 19.

FIG. 18 shows another lid 110 constructed in accordance with a modification of the invention and which is similar to the lid 35 shown in FIG. 3 and which is partially identified with the same reference numbers for similar structure or components but with the addition of a prime mark. In this embodiment, a vacuum or pressure release button 120 has a top wall portion 122, and a surrounding side wall portion 124 projects downwardly to a surrounding annular flange portion 126 connected to the top wall portion 23' of the lid by an annular inclined wall portion 128. Referring to FIGS. 19 and 20, the flange portion 126 of the push button 120 has a main or first score line 130 and a second score line 132 which is spaced radially outwardly from the first score line 130 by a distance D (FIG. 22) of about 0.025 inch. Both of the score lines 130 and 132 have a "V" shaped center portion and extend an angle A of about 70 degrees with the main score line 130 tapering into the metal to the center of the "V".

Figure 22:
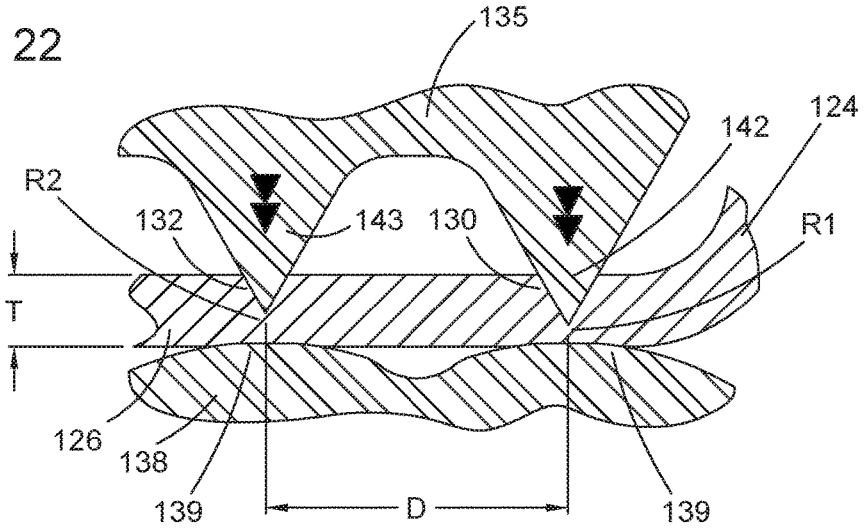
FIG. 22 is an enlarged fragmentary section of the tooling for forming the main score line a secondary score line shown at 22 in FIG. 20.

As shown in FIG. 22, the score lines 130 and 132 are formed by a die 135 which is pressed into the flange portion 126 supported by an anvil 138 having rounded surfaces 139 below the V-shaped scoring portions 142 and 143 of the die 135. When the score lines 130 and 132 are pressed into the flange portion 126 against the anvil 138, the residual metal thickness R1 formed by the main or first scoring die portion 142 is about 0.001 inch at the center of the "V", and the residual metal thickness R2 formed by the scoring die portion 143 is about 0.002 inch. As shown in FIG. 20, the main or first score line 130 is located adjacent the bottom of the side wall 124 of the button 120. The second score line 132 is located radially outwardly from the first score line 130 by about 0.025 inch.

Figure 23:
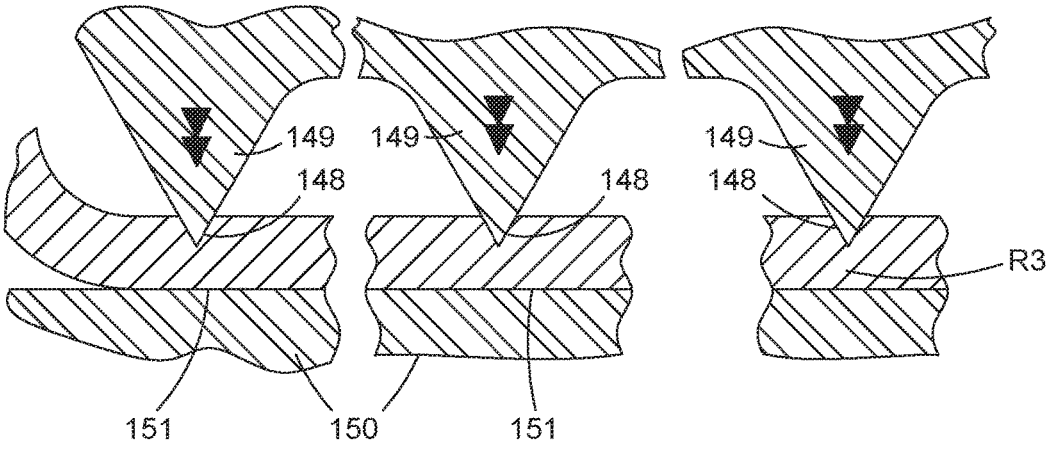
FIG. 23 is an enlarged fragmentary section of the tooling for forming an ancillary or third score lines shown at 23 in FIG. 21.
Figure 24:
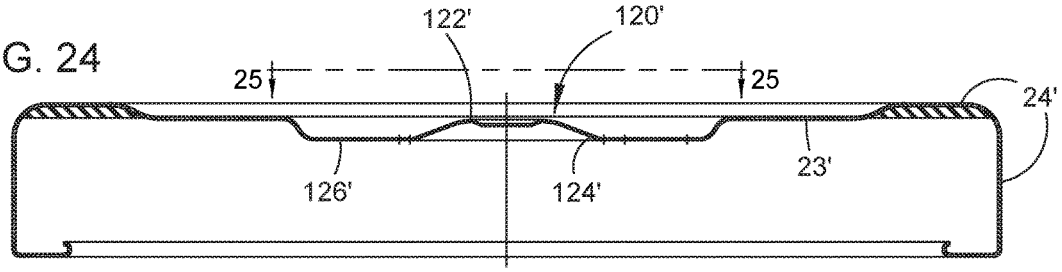
FIG. 24 is an axial section of a lid similar to FIG. 18 and showing a modified embodiment of the invention.
Figure 25:
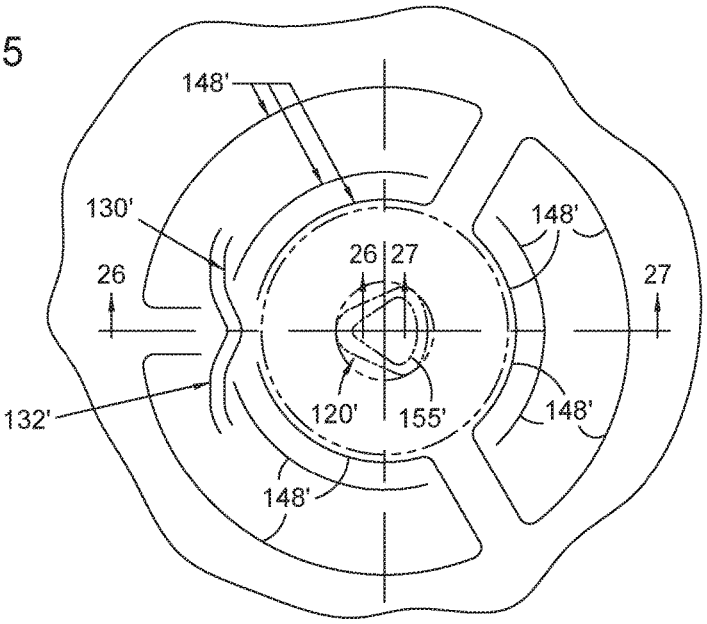
FIG. 25 is a plan or top view of the modified embodiment, taken generally on the line 25-25 of FIG. 24.
Figure 26:
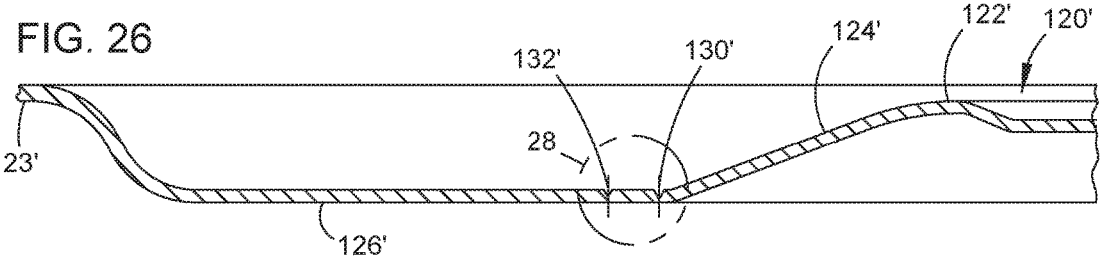
FIG. 26 is an enlarged fragmentary section taken on the line 26-26 of FIG. 25.
Figure 27:
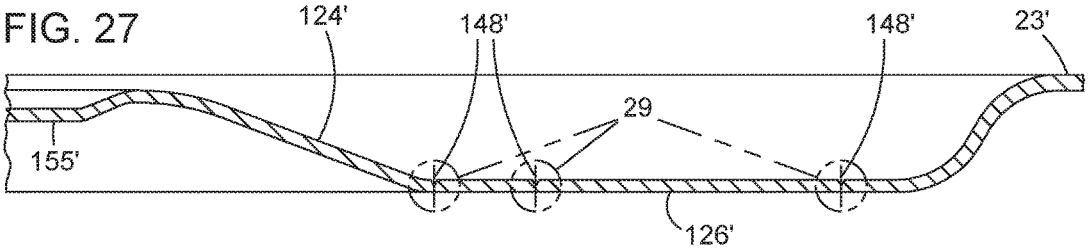
FIG. 27 is an enlarged fragmentary section taken on the line 27-27 of FIG. 25.

Referring to FIGS. 19 and 23, an array or series of ancillary or third score lines 148 are arcuate and radially within the flange portion 126 of the button 120 and are formed by the scoring dies 149 and an anvil 150 having a flat surface 151 to form a metal residual R3 within the flange portion 126 of about 0.0035 inch. Also formed within the top wall 122 of the button 120 is a triangular recess 155 to form an arrow indicating where the top wall 122 should be pressed in order to rupture the main or first score line 130 in response to depressing the top wall 122 of the button.

Figure 28:
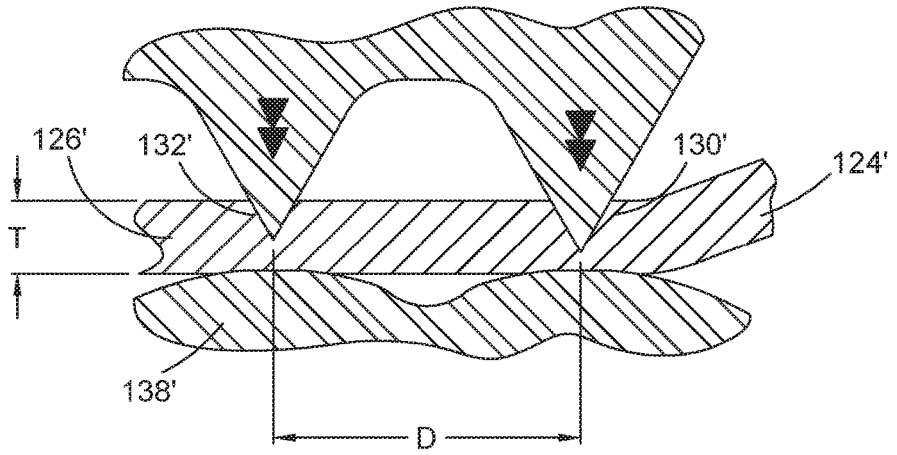
FIG. 28 is a fragmentary section of tooling similar to FIG. 22 and showing the score lines identified at 28 in FIG. 26.
Figure 29:
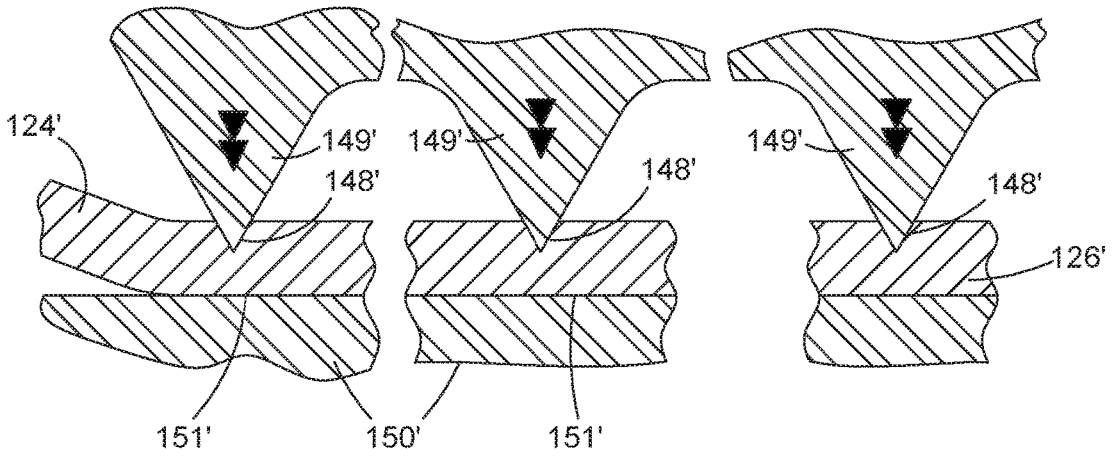
FIG. 29 is an enlarged fragmentary section of the tooling for producing the score lines at 29 in FIG. 27.

FIGS. 24-27 show a modified form of a button 120' which is identified with some of the same reference numbers as used to describe the push button 120, but with the addition of a prime mark. The difference in the button 120' is that the surrounding annular side wall 124' slopes downwardly from the top wall portion 122' to the annular flange portion 126'. In all other respects, the score lines 130', 132' and 140' are formed at the same depth as described above for the corresponding score lines in FIGS. 22 and 23. Referring to FIGS. 28 and 29, these show the scoring dies which are the same as disclosed in FIGS. 22 and 23 except for forming the first score line 130', the second score line 132' and the third score lines 148' in the flange portion 126' having the sloping side wall portion 124'.

Figure 30:
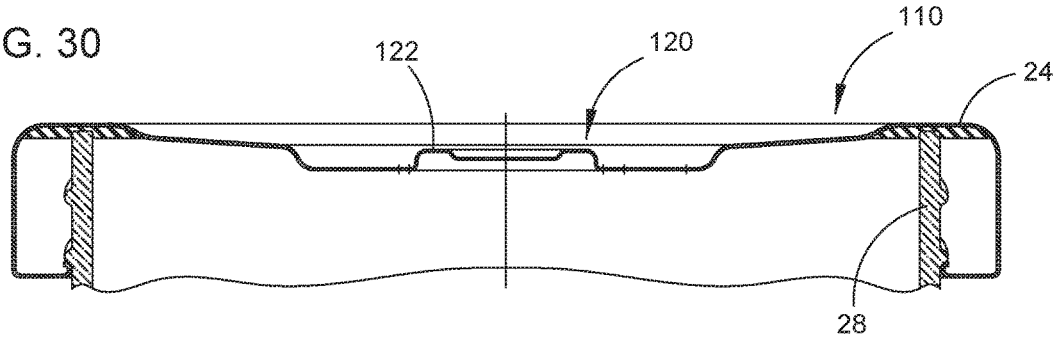
FIG. 30 shows the lid of FIG. 18 attached to a container having a vacuum.
Figure 31:
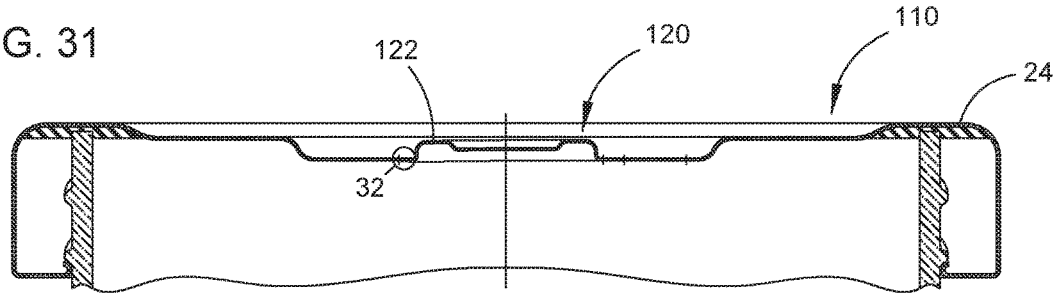
FIG. 31 shows the lid of FIG. 30 after the vacuum is released.
Figure 32:
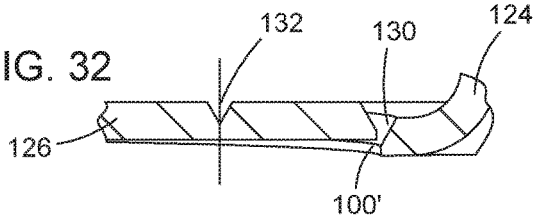
FIG. 32 is an enlarged fragmentary section shown at 32 in FIG. 31 after the vacuum is released.

FIG. 30 illustrates the removable lid 110 with the push button vacuum release button 120 attached to a container 28 and shown slightly concaved as a result of a vacuum within the container 28. With a vacuum in the container 28, the top wall portion 122 of the push button 120 is below the chime or rim 24 of the lid 110. When the top wall portion 122 of the button 120 is pushed downwardly, the main or first score line 130 is slightly ruptured, as shown in FIG. 32 to define a small slit or gap 100' to release the vacuum or air within the container. As shown in FIG. 31, when the vacuum is released, the top wall portion 122 of the button 120 is still below the chime 24 of the lid 110.

Figure 33:
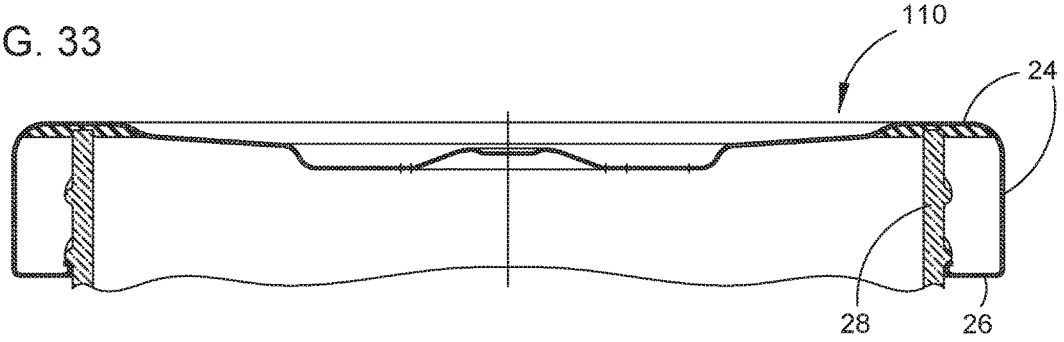
FIG. 33 shows the lid of FIG. 24 attached to a container having a vacuum within the container.
Figure 34:
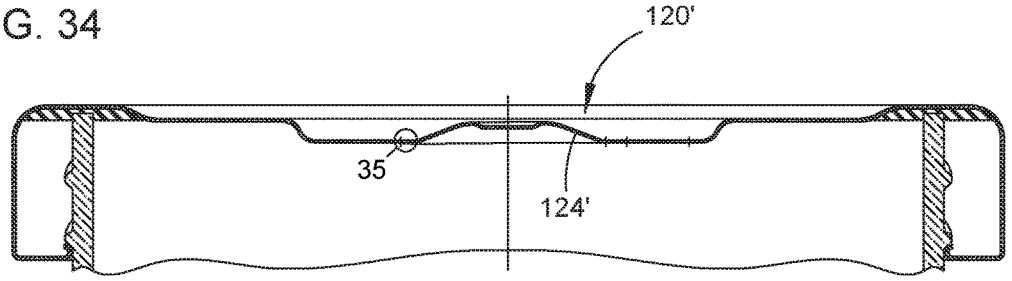
FIG. 34 shows the lid of FIG. 33 after the vacuum is released.
Figure 35:
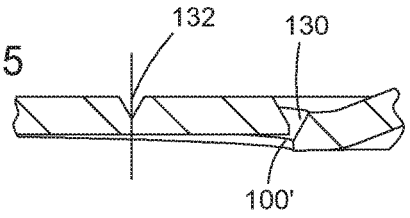
FIG. 35 is an enlarged fragmentary section of the lid shown in FIG. 34 after the vacuum has been released.

FIGS. 33-35 are similar to FIGS. 30-32 except that the lid 110' has a push button 120' with a sloping or inclined annular side wall 124' as shown in FIGS. 24-27, with the vacuum release button 120' having the main or first score line 130', the secondary score line 132' and the ancillary or third score lines 148'. The primary purpose of the second score lines 132 and 132' and the third score lines 148 and 148' are to minimize any distortion or wrinkles within the flange portion 126 and 126' and thereby protect the thin plastic coating on the inside surface of lid 110 and 110'.

It apparent from the drawings and the above description that a removable container lid provided with a vent button 40 or 120 or 120' in accordance with the invention, provides desirable features and advantages. For example, the forming the vent button with the score or shear line 60 as shown in FIGS. 9 & 11 or the shear or score lines as shown in FIGS. 12-14 and FIGS. 19-21 and 25-27, provide for obtaining precision and dependable control over the desired pressure on the button to produce a very small gap 100 or 100' between the opposing flange portions. Also, when the pressure on the top wall portion is released, the spring hinge effect in the sheet metal produced by the annular flange portion on the opposite ends of the score line causes the opposing flange portions to return to their original opposing position or causes the lip portion 97 of the sealant material to recontact the flange portion 48', thereby closing the gap 100 to prevent or restrict liquid within the container from flowing through the gap 100 from the container in the event the container was accidentally tilted onto its side. After the vent gap is open, a light outward or upward pressure on the opposing flange portions defining the gap will also cause the annular flange portion to snap overcenter, thereby closing the gap.

While the reclosable lids and vacuum or pressure release buttons and their method of construction herein described constitute preferred embodiments of the invention, it is to be understood that the invention is not limited to the precise methods and forms of release button described, and that changes may be made therein without departing from the scope of the invention as defined in the appended claims.

What is claimed is:

1. A sheet metal lid having a vertical axis and including a top wall and a peripheral rim portion with a bonded sealant material, and adapted to be releasably secured to a container receiving a vacuum or pressure enclosed product, the lid comprising, a portion of the top wall defining a vent button having a top wall portion, a surrounding annular side wall portion with an outwardly projecting flange portion extending around the side wall portion below the top wall of the lid, the flange portion having a first score line adjacent the side wall portion of the button and projecting substantially into the thickness of the sheet metal forming the flange portion, a second score line within the flange portion and spaced radially outwardly from the first score line, the second score line extending into the flange portion at a depth less than the depth of the first score line, the first score line being effective to rupture without rupturing the second score line in response to a predetermined downward pressure on the top wall portion of the vent button to define a narrow gap along the first score line for releasing vacuum or pressure from the container, and a third score line extending into the flange portion at a depth less than the depth of the second score line and cooperating with the second score line to minimize distortion of the flange portion when the flange portion flexes downwardly before the first score line is ruptured.

2. The lid of claim 1 wherein the third score line is arcuate and extends partially around the side wall portion of the vent button.

3. The lid of claim 1 wherein the side wall portion of the vent button is annular and slopes downwardly from around the top wall portion of the vent button to the flange portion of the vent button.

4. The lid of claim 1 wherein the radial spacing between the first score line and the second score line in the flange portion of the vent button is about 0.025 inch.

5. An aluminum sheet metal lid having a vertical axis and including a top wall and a peripheral rim portion with a bonded sealant material, and adapted to be releasably secured to a container receiving a vacuum or pressure enclosed product, the lid comprising, a portion of the top wall defining a vent button having a top wall portion, a surrounding side wall portion with an outwardly projecting flange portion extending around the side wall portion below the top wall of the lid, the flange portion having a first arcuate score line projecting into the flange portion adjacent the side wall portion of the button and extending substantially into the thickness of the sheet metal forming the flange portion, the first arcuate score line including a V-shape portion extending arcuately less than seventy degrees relative to the vertical axis, the first score line being effective to rupture without rupturing the second score line in response to a predetermined downward pressure on the top wall portion of the vent button to define a small narrow gap along the first score line for releasing vacuum or pressure from the container, a second arcuate score line within the flange portion and spaced radially outwardly from the first score line in substantially parallel relation, the second score line extending into the flange portion at a depth less than the depth of the first score line, the second score line including a V-shape portion extending arcuately less than seventy degrees relative to the vertical axis, and third score lines extending into the flange portion at a depth less than the depth of the second score line and effective to minimize distortion of the flange portion of the button when the flange portion flexes downwardly before the first score line is ruptured.

6. The lid of claim 5 wherein the third score lines are arcuate and extend partially around the side wall portion of the vent button.

7. The lid of claim 5 wherein the third score lines are concentric and include radially extending third score lines within the flange portion of the vent button.

* * * * *